United States Patent [19]

Selick

[11] 4,095,100

[45] June 13, 1978

[54] LIGHT RESPONSIVE SWITCH

[75] Inventor: David Selick, Tenafly, N.J.

[73] Assignee: Selco Electronics, Inc., Palisades Park, N.J.

[21] Appl. No.: 710,356

[22] Filed: Jul. 30, 1976

[51] Int. Cl.[2] ..... H01H 47/24; H01H 61/013

[52] U.S. Cl. ..... 250/206; 250/214 AL; 315/159; 361/173

[58] Field of Search ..... 315/149, 159, 362; 250/206, 214 AL, 239; 361/173, 211

[56] References Cited

U.S. PATENT DOCUMENTS

| | | | |
|---|---|---|---|
| 2,155,224 | 4/1939 | Geffcken et al. | 315/159 X |
| 2,792,533 | 5/1957 | Richards | 361/211 |
| 3,914,598 | 10/1975 | Schacht et al. | 315/159 X |

*Primary Examiner*—Eugene R. LaRoche
*Attorney, Agent, or Firm*—Howard C. Miskin

[57] ABSTRACT

An ambient light responsive switch for street lamps or other loads, includes a thermostatic switch of the thermal time delay relay type, connecting a load to a current source and exposed to a heater resistor and snap opening and closing at relatively high and low temperature values. An ambient light exposed photoconductor, a first resistor and the heater resistor are series connected across the current source, and the first resistor and a second resistor are series connected across the switch. With the closing of the switch in response to a low light value the load is energized and the resistance in series with the heater resistor is accordingly lowered to increase the heater current. With the opening of the switch in response to a high light value the load is deenergized and the resistance in series with the heater resistor is accordingly increased to decrease the heater current and reduce the sensitivity of the switch. The combined effect reduces the difference in light intensities at which the switch opens and closes to about zero.

6 Claims, 5 Drawing Figures

LIGHT RESPONSIVE SWITCH

BACKGROUND OF THE INVENTION

The present invention relates generally to improvements in light responsive switching devices and it relates more particularly to an improved switching device responsive to the ambient light for controlling the energization of street lighting lamps or other loads.

It is a common practice in the control of the lighting and extinguishing of street lamps to connect each of the lamps to a source of current through an individual light responsive switch so that the respective lamp is energized and de-energized with the ambient light falling below and exceeding pre-determined values respectively. A photoresponsive switch device which has heretofore been widely used for the above purposes is of the type including a snap type thermostatic switch through which the load is connected to a source of current, the switch temperature responsive element being exposed to and heated by a heater resistor which is connected through an ambient light exposed photoconductor to the current source so that the heater is controlled by the ambient light and, in turn, controls the opening and closing of the switch with increased and decreased ambient light values. While this type of switch, as presently available, has many desirable features it possesses numerous drawbacks and disadvantages.

The light responsive switch devices presently employed have an inherent differential between the make and break of the contacts. This differential, when the relay is installed in a conventional street lighting circuit is translated into a turn-off/turn-on ratio of 2:1 to 5:1 for most photocontrols. If it is desired to turn on a street light a one foot candle ambient light at night, the conventional photocontrol will turn off at from 2 to 5 foot candles in the morning. This is highly uneconomical and inefficient and represents a useful lighting time and a great waste of power. With the constant increase in the cost of energy and the decrease in the availability thereof, the above waste becomes more intolerable.

Furthermore, a photocell ages from the internally generated heat and as it ages the cell resistance usually increases. As a result the switch device employing such a cell will turn on earlier each night and turn off later each morning. This also represents a significant waste of power and gets progressively worse until the photocontrol eventually fails in the "on" position.

SUMMARY OF THE INVENTION

It is a principal object of the present invention to provide an improved light responsive switch device.

Another object of the present invention is to provide an improved light responsive switch device of the thermostatic switch type.

Still another object of the present invention is to provide an improved light responsive switch device wherein the difference between the light intensities transferring the switch to its open and closed position may be adjusted substantially to zero or any small predetermined differential.

A further object of the present invention is to provide an improved light responsive switch device, which is of great stability and of uniform sensitivity and operation even after long periods of use and is highly efficient.

Still a further object of the present invention is to provide a device of the above nature which is highly suitable for the energization control of street lamps and is characterized by its high reliability, ruggedness, simplicity, low cost and great versatility and adaptability.

The above and other objects of the present invention will become apparent from a reading of the following description taken in conjunction with the accompanying drawing which illustrates a preferred embodiment thereof.

In a sense the present invention contemplates the provision of an improved light responsive switch device comprising an electric resistance heating element, a thermostatic switch exposed to the heat from the heating element and transferrable between opposite first and second states in response to the temperature thereof, means including a photoconductor connecting the heating element to a source of current and means responsive to the transfer of the thermostatic switch between the first and second states for varying the current through the heating element.

In the preferred form of the improved device a first resistor, the resistance heater and photoconductor are series connected across the current source, the switch being shunted by the first resistor and a second resistor connected in series. The controlled load is connected through the switch across the current source. The elements of the switching device are mounted on an insulator base provided with three coupling prongs to which appropriate points of the switch network are connected to facilitate the coupling thereof to the load and the current source. The thermostatic switch is, per se, of broadly known construction of the thermal time delay relay type, including a bimetallic arm about which the resistance heater is wound and which adjustably bears and acts on a bistable switch arm which is snap transferrable between opposite states, the transfer position or force being mechanically adjustable.

The temperatures at which the thermostatic switch transfers to opposite states are different and the values of the heater and resistor resistances and the response of the photoconductor are such and the switch operating parameters are so adjusted that the difference between the values of the light incident on the photoconductor in effecting the transfer of the switch to its first or second states is approximately equal to or a little greater than zero.

The improved photoelectric switch device is capable of timing the load energization on and off at the same light level, for example, one foot candle turn-on and one foot candle turn-off, and is capable of reducing by half the heat generated in the photocell after the switching point occurs thereby improving the stability and ultimately the life of the photoconductor photocell. Further, the photoelectric switch circuit advantageously cuts the power to the heater in half when the switching point occurs, thus making adjustment of the switch uncomplicated and untedious. Once the "turn-off" point has been determined by photometric means, the "turn-on" point can be simply adjusted by removing power, allowing the photocontrol to cool, measuring the mechanical pressure required to turn off the switch, dividing this figure in half, and adjusting the turn-on point to this value. This mechanical adjustment is not only easy but eliminates oscillations which might occur if the switch were to be adjusted electrically whereby quick comparison of turn-off and turn-on points might be difficult.

The improved switch device is of high reliability and stability and greatly improves the operating cycle and increases the efficiency of operation of such loads as street lighting lamps and the like.

DESCRIPTION OF THE PREFERRED EMBODIMENT

Figure 1:
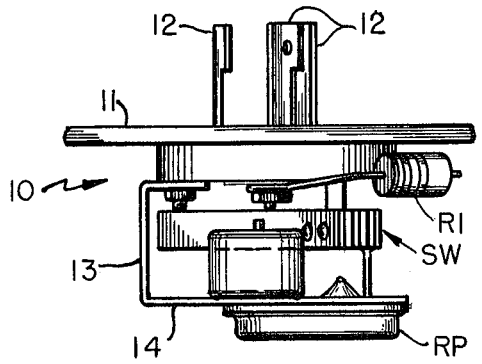
FIG. 1 is a front elevational view of a switch device embodying the present invention.

Referring now to the drawing which illustrates a preferred embodiment of the present invention the reference numeral 10 generally designates the improved switch device which is advantageously in the form of a plug unit including a circular insulator base 11 provided with three upstanding contact prongs for coupling to a mating socket having contacts connected to one terminal of the lamp load, another terminal of which is connected to the neutral line and the third terminal is connected to the hot line which define the current source. A metal ground defining bracket is secured to and depends from the base 11 and includes an end plate 14 on which is mounted a suitably encased photoconductor RP which is exposed to the ambient light.

Suitably mounted on the base 11 is a thermostatic switch SW which includes a bi-stable or snap type switch arm SWa, an associated switch contact SWb and a bi-metallic actuating arm in heat transfer relationship with which a resistance heater RH is wound. An adjusting screw bearing on which arm SWa is provided so as to permit the varying of the pressure therein by the bi-metallic arm. A second adjusting screw sets the contact gap and bears on the opposite face of switch arm SWa. The bi-metallic switch SW is of broadly known construction.

In accordance with the present invention the photoconductor RP, the resistance heater RH and a resistor R1 are connected consecutively in series between the neutral line *y* and the hot line *x* of a source of current. The load RL which may be a street lamp is connected through the switch SW between lines *x* and *y* and a second resistor R2 is connected in series with resistor R1 across the switch SW. The bi-metallic arm is so oriented that when heated above a first adjustable predetermined temperature acts on the switch arm to open switch SW and when it falls below a second adjustable predetermined temperature less than the first temperature release the switch to its closed condition.

Figure 3:
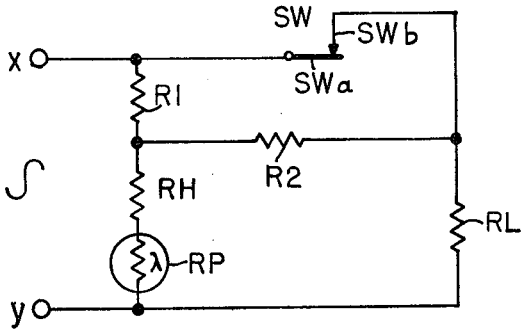
FIG. 3 is a circuit diagram thereof.
Figure 2:
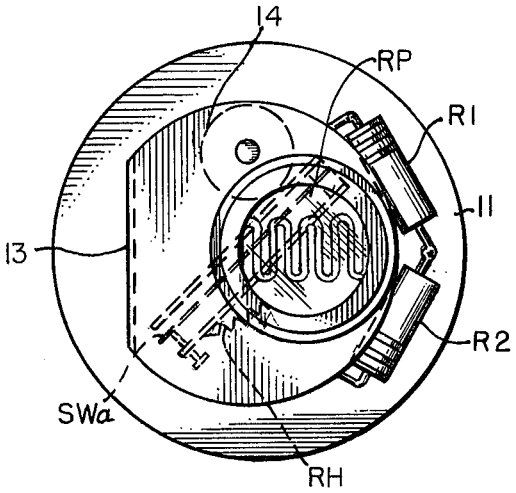
FIG. 2 is a top plan view thereof.
Figure 5:
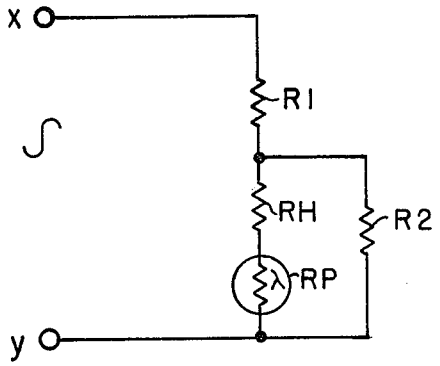
FIG. 5 is the heater equivalent circuit with the switch in open condition.

In the operation of the improved switch device 10 in controlling the load RL to be energized in response to the ambient light, when the switch SW is closed, the heater RH is energized by the current through the parallel connected resistors R1 and R2 in series with heater RH and photoconductor RP, and with the light increasing to a predetermined level the switch SW is heated to its relatively high opening temperature to open the switch and de-energize the load RL. The opening of switch SW places R2 [through RL] across RH and RP as shown in FIG. 5. As the ambient light incident on photoconductor RP decreases, the temperature of switch SW effected by the heater RH decreases due to the reduced current through the heater until the switch SW closes, as shown in FIG. 3, to energize the load RL.

As explained above, the electrical and mechanical parameters of the various components are such that the switch SW transfers to its open and closed state from its opposite state at about the same value of light incident on the photoconductor RP.

In an example of the improved light responsive switch the resistor R1 is 1.8K ohms, the resistor R2 is 4.3K ohms and the heater resistor RP is 7.5K ohms as compared to a conventional heater resistor of 4.7K ohms. The maximum photoconductor power is 395 milliwatts as compared to 739 milliwatts of the photoconductor in a conventional device of the subject type. The ratio of turn-off to turn-on in the present device is about 1:1 as compared with the corresponding conventional device without the RL, R2 network of a ratio of 2:1 or more. Power levels in the photoconductor in the present device are only over 200 milliwatts from incident light values of about 0.1 foot candles to the switch opening value which is set at about 1 foot candle. These power levels drop to about 200 milliwatts at the opening of the switch and progressively decrease with increased incident ambient light. It should be noted that at sunset at temperate latitudes that the ambidne light decreases from 1.0 to 0.1 foot candle in about 18 minutes and increases this amount at sunrise in about 18 minutes for a total of 36 minutes over 200 milliwatts for each day. This is a decrease of 60 minutes each day below that of the conventional device.

Figure 4:
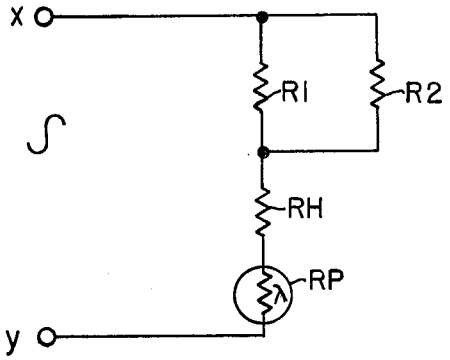
FIG. 4 is the heater equivalent circuit with the switch in closed condition.

At night times with the switch SW closed the equivalent circuit is as shown in FIG. 4 with the parallel resistors R1 and R2 having a resistance of 1.27K ohms as compared to the 1.8K ohm value of resistor R1, thus making the switch SW more sensitive to turn off at a lower level. When the switch SW opens the resistor R2 is connected in series with theload RL across the series connected photoconductor RP and resistance heater RH making the switch device less sensitive and the turn-on level higher and also reduce the heat generated in the photoconductor and hence extend its life. The power is cut approximately in half.

While the above description illustratively uses a light sensing element, a heat sensing element, such as a thermistor or a pressure sensing element, such as a transducer could be substituted thereof.

While there has been described and illustrated a preferred embodiment of the present invention, it is apparent that numerous alterations, omissions and additions may be made without departing from the spirit thereof.

I claim:

1. A light responsive switch device comprising an electric resistance heating element, a thermostatic switch exposed to the heat from said heating element and including a single pair of contacts transferrable between open and closed positions in response to the temperature of said switch being at relatively high and low temperatures respectively, a load connected to a current source through said pair of contacts, means including a photoconductor connecting said heating element through said photoconductor to said source of current and regulating means and responsive to the opening and closing of said pair of contacts for respectively decreasing and increasing the current through said heater element.

2. The switch device of claim 1 wherein said pair of contacts transfers to its closed state at a lower temperature than it transfers to its open state.

3. The switch device of claim 1 wherein said regulating means includes a first resistor connected in series with said heating element and means connecting said pair of contacts across said first resistor.

4. The switch device of claim 3 wherein said connecting means includes a second resistor connected in series with said pair of contacts.

5. The light responsive means of claim 1 wherein said regulating means is responsive to the opening and closing of said contacts for respectively decreasing and increasing the current through said photoconductor.

6. The light responsive means of claim 5 wherein said regulating means includes first and second resistors, said first resistor, said heating element and said photoconductor being consecutively series connected across said current source, said pair of contacts and said second resistor being connected across said first resistor and said load being connected through said second resistor across the series connected heating element and photoconductor.

* * * * *